United States Patent [19]

Dragon, Jr. et al.

[11] Patent Number: 4,575,409

[45] Date of Patent: Mar. 11, 1986

[54] APPARATUS FOR ELECTROLYZING METAL SHEET

[75] Inventors: Robert L. Dragon, Jr., Hazlet; Lawrence C. Grambo, Westfield; John E. Walls, Hampton, all of N.J.

[73] Assignee: American Hoechst Corporation, Somerville, N.J.

[21] Appl. No.: 568,328

[22] Filed: Jan. 5, 1984

[51] Int. Cl.[4] ..... C25D 21/10; C25D 17/06; C25C 7/00

[52] U.S. Cl. ..... 204/237; 204/271; 204/275; 204/286; 204/297 R; 204/279; 204/273

[58] Field of Search ..... 204/198, 225, 269, 275, 204/285, 286, 287, 297 R, 297 W, 140, 237, 271, 279, 224 R, 273, 278, 5, DIG. 7, 267

[56] References Cited

U.S. PATENT DOCUMENTS

| | | | |
|---|---|---|---|
| 866,858 | 9/1907 | Hendryx | 204/297 W |
| 1,354,234 | 9/1920 | Blaetz | 204/297 W |
| 1,395,704 | 11/1921 | Gerstle | 204/267 |
| 1,534,913 | 4/1925 | Claybourn | 137/322 X |
| 1,984,745 | 12/1934 | Kaizik | 204/267 |
| 2,533,464 | 12/1950 | Jasper | 204/297 W |
| 2,675,348 | 4/1954 | Greenspan | 204/5 X |
| 2,861,932 | 11/1958 | Pohl | 204/273 X |
| 3,013,959 | 12/1961 | Ventre | 204/297 W |
| 3,039,951 | 6/1962 | Clenard et al. | 204/297 |
| 3,072,546 | 1/1963 | Wruck | 204/140 |
| 3,073,765 | 1/1963 | Adams | 204/140 |
| 3,342,718 | 9/1967 | Adams | 204/273 |
| 3,834,176 | 7/1974 | Crowe | 204/297 R |
| 4,220,508 | 9/1980 | Kotani et al. | 204/129.65 |
| 4,272,351 | 6/1981 | Kotani et al. | 204/202 |
| 4,425,214 | 1/1984 | Pellegri | 204/254 |

FOREIGN PATENT DOCUMENTS

| | | | |
|---|---|---|---|
| 642100 | 6/1962 | Canada . | |
| 968 | of 1892 | United Kingdom | 204/286 |
| 1417988 | 1/1972 | United Kingdom . | |

*Primary Examiner*—Donald R. Valentine
*Attorney, Agent, or Firm*—Richard S. Roberts

[57] ABSTRACT

Provided is a device useful for the uniform electrolysis of a metal sheet workpiece. It is especially useful for the laboratory scale testing of various methods of electrolytically etching aluminum. The device has a generally rectangular frame having non-electrically conducting walls capable of containing an electrolyte; at least one electrode; electrically conducting clamping means to rigidly hold a metal workpiece within the frame at a fixed distance from the electrode; means for circulating the electrolyte about the workpiece; and means for applying a current between the workpiece and electrode.

5 Claims, 5 Drawing Figures

APPARATUS FOR ELECTROLYZING METAL SHEET

BACKGROUND OF THE INVENTION

The present invention relates to a device for the uniform electrolysis of a metal sheet on both side surfaces thereof. The device is especially useful in a laboratory to produce samples of etched or "grained" metal sheets, especially aluminum sheets. These grained sheets, when produced on a commercial scale, are used as substrates which are coated with a photosensitive composition in the manufacture of lithographic printing plates. By using this laboratory scale device to test various etching or other electrolysis processes, one gains the advantages of less cost, greater ease of operation and greater control as compared to carrying out such development work on a pilot line.

While numerous prior art devices are available for electrolytic processing of metal sheet materials, none are shown to posses all the features and advantages of the present invention with respect to uniformity of etching and repeatability of results.

BRIEF DESCRIPTION OF THE PRIOR ART

Problems encountered in the surface treatment of metal sheet materials include maintaining a uniform electrical current across the entire surface to be treated as well as providing uniform agitation of the fluid medium to produce uniform graining. Previous attempts to overcome these problems include:

U.S. Pat. No. 3,039,951 to Clenard et al provides an electro-plating fixture whereby the fixture is immersed in a plating solution, which solution is agitated by means of air directed through a perforated, inverted trough arrangement.

U.S. Pat. No. 4,272,351 to Kotani et al teaches an apparatus for electrolytic etching which provides for etching one side of a sheet material by removably mounting said material on an insulating frame disposed between the anode and the cathode with the side of the workpiece to be etched facing the cathode.

U.S. Pat. No. 3,824,176 to Crowe for a matrix holder provides a hinged frame type holder including spring loaded electrical connectors for conducting current to the edges of the electroforming matrix.

U.S. Pat. No. 1,543,913 to Claybourn provides a mold support which provides for mounting and suspending plates by means of clamping devices maintained in slidable grooves.

British Pat. No. 1,417,988 to Nutt teaches an apparatus for use in forming battery plates which provides an insulating container having disengagable inside walls for use in forming battery plates.

U.S. Pat. No. 2,533,464 to Jasper discloses a rack for supporting flat metal sheets in electro-plating operations, and provides for means to support and agitate sheet materials for multiple immersion in plating and cleaning solution. The rack type support has laterally spaced fastening means.

U.S. Pat. No. 3,013,959 to Ventre shows a rack for supporting flat metal sheets in electrolytic operations and provides a support for sheet material utilizing spring-type holding members.

U.S. Pat. No. 1,354,234 to Blaetz reveals a holder for electroplating which provides support means for lead plates for vertical positioning in a bath.

SUMMARY OF THE INVENTION

The invention comprises a non-electrically conductive frame adapted for immersion in an electrolytic solution and having at least one and preferably a pair of electrodes mounted thereon which are spaced a distance apart to receive a metal sheet to be electrolyzed centered therebetween. Means on the frame, specifically, its groove structure, are provided for rigidly holding the peripheral edges of the metal sheet such that each side surface of the sheet is immersed in electrolyte and spaced at a pre-selected distance from the electrodes. A sheet clamping member holds a portion of the metal sheet periphery and serves as an electrical conductor to carry electrical current from a source to the metal sheet. There is also provided means for circulating electrolyte uniformly about both side surfaces of the metal sheet and means for applying an electrical current to the electrodes. The electrolysis may be conducted for a variety of purposes such as for sheet etching, polishing, plating, cleaning or anodizing as well as for the electrodeposition of materials onto the sheet. Such deposited materials may be hydrophilizing agents such as polyvinyl phosphonic acid or sodium silicate, or may be a photosensitive diazo composition. Furthermore, electric current may be A/C, D/C or pulsed in nature. Current may be made to flow between the two electrodes, between one electrode and the metal workpiece or between both electrodes and the workpiece. Current may be single or three phased.

The invention provides a device for uniformly electrolyzing a metal sheet comprising:

(a) a generally rectangular, non-electrically conductive frame defined by planar walls, which is capable of supporting a metal sheet within said walls and which is adapted for immersion in a tank capable of containing an electrolytic solution therein;

(b) at least one electrode on at least one wall inside said frame, spaced at a distance from, and in a plane parallel to the metal sheet;

(c) electrically conductive clamping means capable of rigidly holding at least one of the peripheral edges of the metal sheet such that at least one of the sides of the metal sheet is uniformly spaced at a pre-selected distance from said electrode;

(d) means for circulating electrolyte uniformly about the surface of said metal sheet and;

(e) means for applying an electrical current between said electrode or electrodes and/or said metal sheet.

DESCRIPTION OF THE PREFERRED EMBODIMENT

Figure 1:
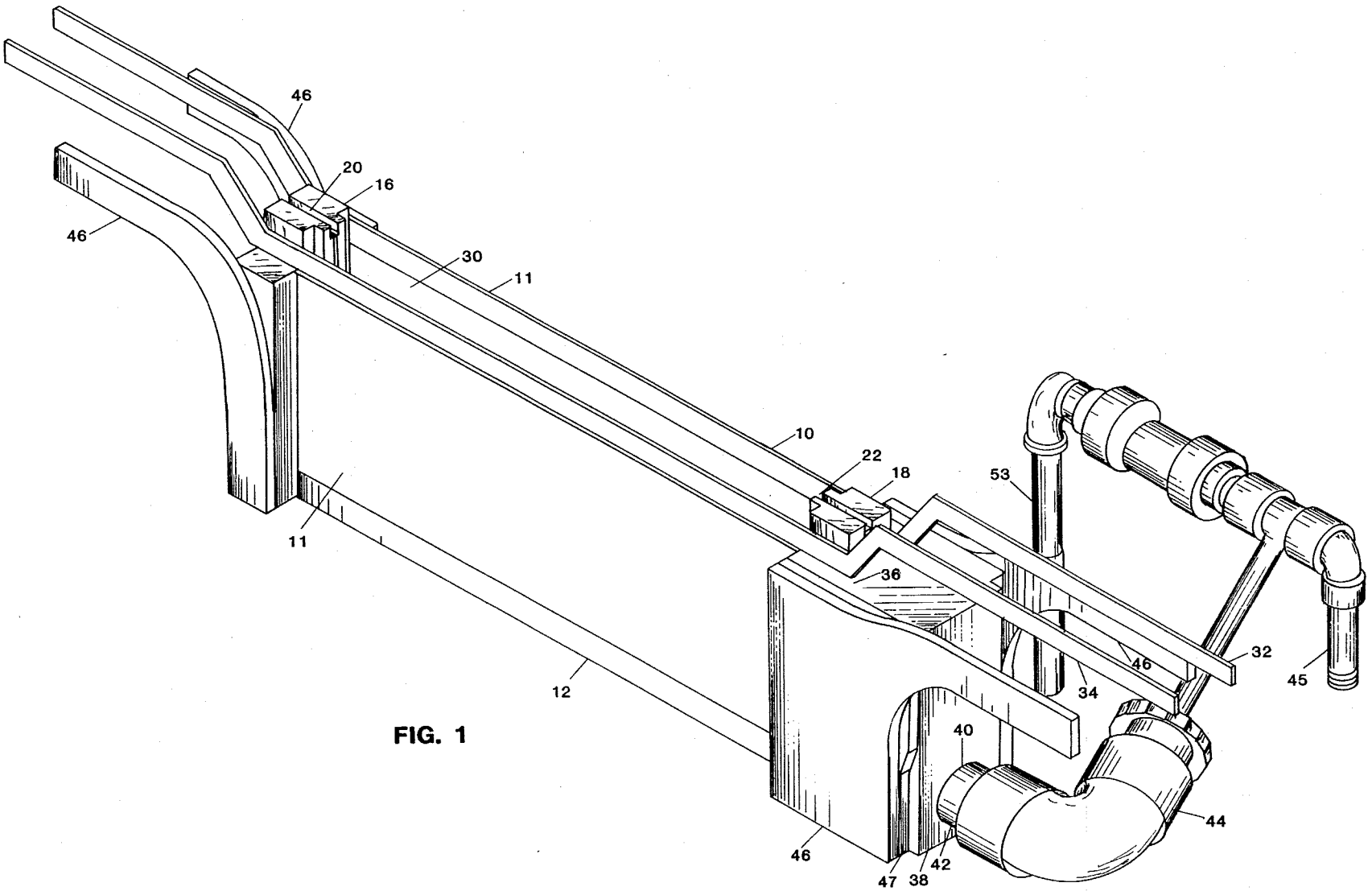
FIG. 1 is a perspective view of the frame portion of the inventive device.
Figure 4:
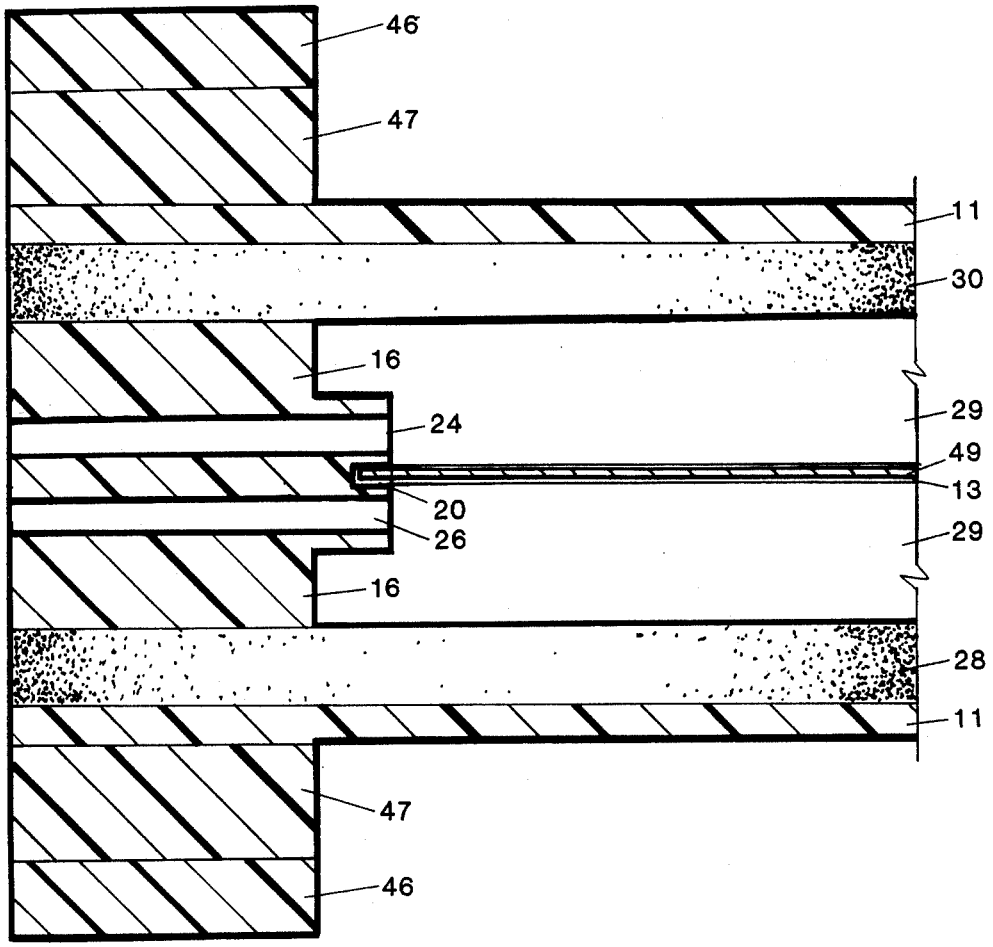
FIG. 4 is a sectional view taken on line I—I' of FIG. 3 as one looks in the direction of the arrows.

Referring to the drawings wherein like reference numerals designate like parts throughout the several views, FIG. 1 shows the elements of frame 10. It is shown to comprise a pair of nonelectrically conducting side wall members 11 attached to a bottom floor-like member 12. The bottom member 12 has an internal sheet receiving groove 13 centrally located and extending along its length. Seated at spaced apart positions at either end of bottom portion 12 are a pair of upwardly standing sheet support members 16 and 18. Each of these sheet support members has a centrally located sheet receiving groove 20 and 22, respectively, extending from the top to the bottom thereof. Support member 16 has a pair of open channels 24 and 26, as may be seen in FIG. 4, extending therethrough and located on either side of the groove 20. Likewise, support member 18 has a pair of open channels extending therethrough and located on either side of groove 22.

In combination, the side walls, bottom member, and sheet support members enclose a space forming a chamber 29 capable of retaining a flowing stream of an electrolytic solution. Disposed on at least one and preferably on both of the inner surfaces of said wall members 11 are electrodes 28 an 30. An important aspect of this invention is the mounting of a pair of electrodes so that they will be positioned at a fixed distance, for example 1 centimeter, from each side of an aluminum sheet workpiece when it is properly seated in frame 10. The electrodes are mounted on a pair of stainless steel bars 32 and 34 respectively. The bars 32 and 34 are seated on the top of side wall members 11 as shown in FIG. 1. The electrodes are preferably composed of graphite and are mounted directly opposite one another and extend in length and height a distance at least equal to the length and height of the sheet being treated. The steel bars 32 and 34 are connected to a source of electrical current by suitable means at each end thereof which cooperate with conventional quick connecting/disconnecting electrical contacts.

Figure 3:
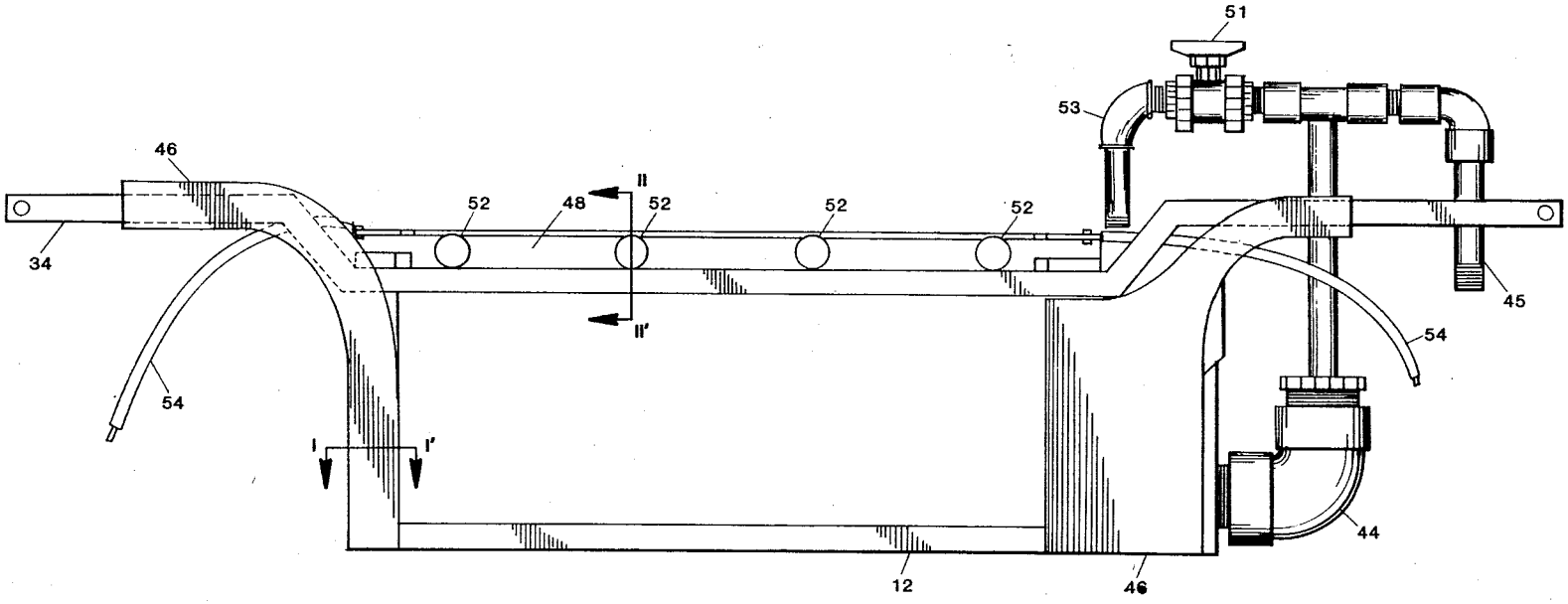
FIG. 3 is a front view of the assembled frame as used in operation with the sheet to be electrolyzed in place.

Electrolyte is caused to flow through the formed chamber by a closed electrolyte entrance port 36 which is provided at one end of the frame 10 as shown in FIG. 1. The floor of the chamber is formed by a portion of bottom member 12. The sheet support member 18 forms one end portion of the chamber and a sealing end plate 38 is provided to enclose the other end. An opening 40 in end plate 38 allows electrolyte to be pumped into entrance port 36 through a tubular member 42 mounted in opening 40. An ordinary pump, not shown, is utilized to pump electrolyte into the entrance port by means of tubing 44 connecting with tubular member 42. The electrolyte then flows into chamber 29 via channels in port 36. Electrolyte is fed to tubing 44 via intake means 45. Electrolyte flow may be controlled by suitable valve means 51 and overflow outlet 53 as shown in FIG. 3.

The insulating frame 10 elements including the bottom portion 12, sheet support members 16 and 18, side wall members 11 and the entrance port 36 parts are each made from any suitable non-conductive, non-corrosive, acid resistant material, i.e. plastic material such as plexiglass, or the like. The components of the device may be secured together by any known means such as a plastic cement or bolts disposed in suitably aligned openings which bolts are coated with epoxy to prevent corrosion from the electrolyte.

In operation, the device is suspended in a large container of electrolyte, not shown, by means of four handles 46 which are attached to frame 10 at blocks 47 at each end as shown. These handles are useful for manually transporting the apparatus and are used to rest the entire device on the edge of the larger container into which the frame 10 is suspended.

Figure 2:
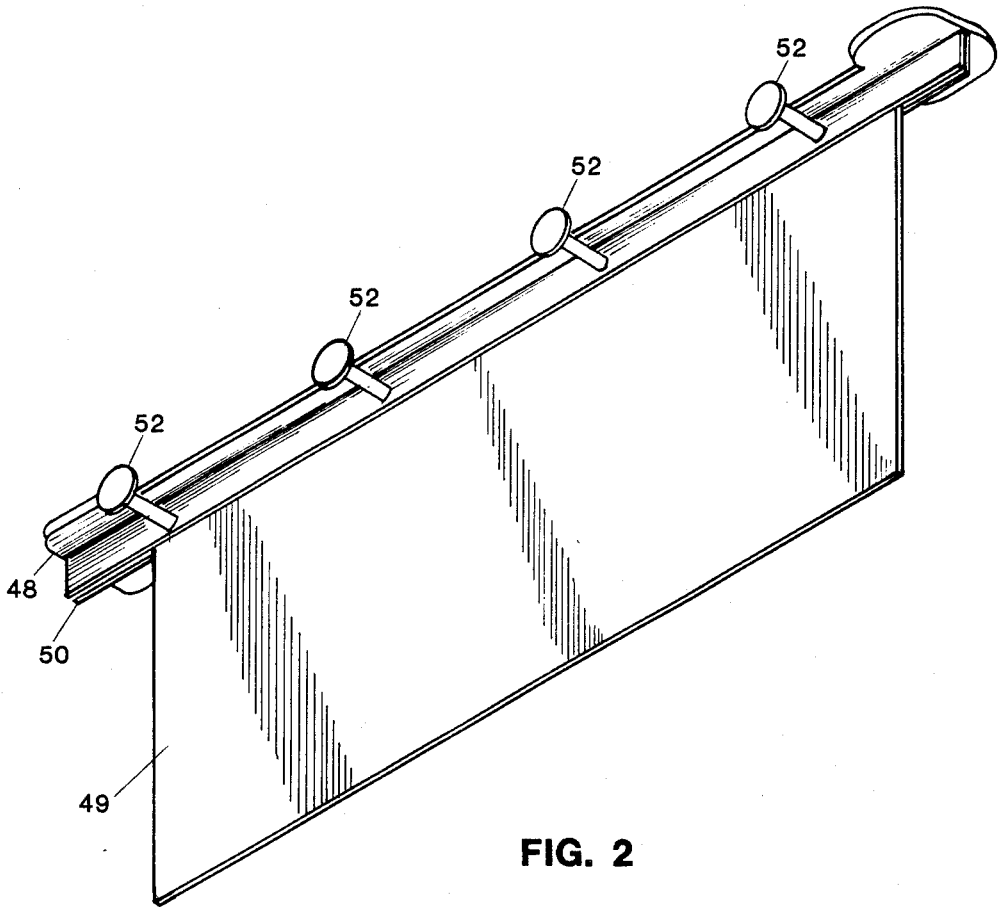
FIG. 2 is a perspective view of the sheet clamping member of the invention having a sheet clamped therein.
Figure 5:
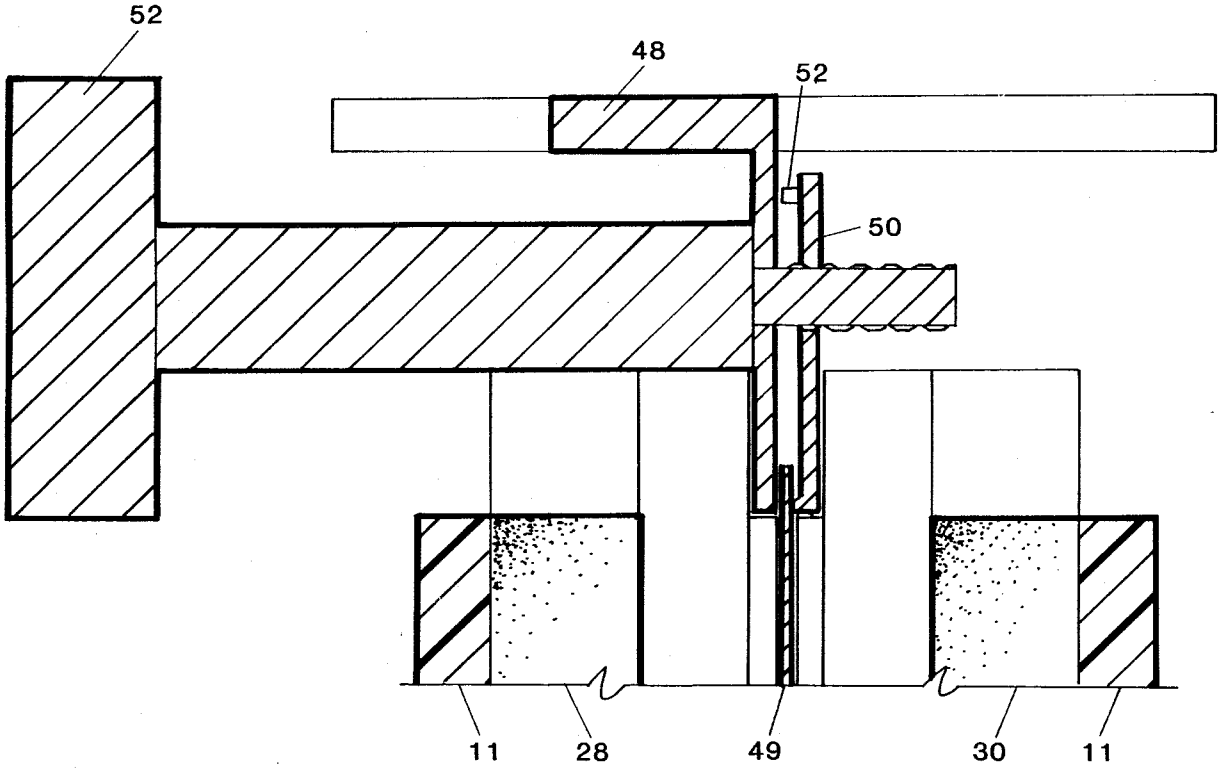
FIG. 5 is a sectional view taken on line II—II' of FIG. 3 as one looks in the direction of the arrows.

FIG. 2 shows a sheet clamping means 48 with a sheet of aluminum 49 clamped thereby along its upper margin. As shown in FIG. 2 the clamping means 48 is electrically conductive and has a generally "T" shaped cross-section. The downwardly extending "stem" portion 50 of the means 48 comprises a movable clamping bar which extends the width of the sheet 49. At several spaced intervals across the width of bar 50, there is provided a pair of aligned openings which are threaded. In order to actuate the clamping mechanism, tightening members 52 are provided for each of the aligned openings. Each of the tightening members include a threaded shaft which extends through the openings and is in threaded engagement with one of the threaded openings in the clamping bar. Each tightening member 52 has a large knurled turning head at the end thereof opposite the threaded shaft. Upon manually turning each turning head clockwise it causes the threads to move the clamping member 50 whereby it may fix the sheet 49 therein. To increase the clamping pressure on the sheet 49 there is located a group of studs 52 at the top margin of the clamping bar. A plurality of these studs 52 are shown in FIG. 5. There is preferably one stud directly aligned with each tightening member and two others, each spaced on either side thereof about an inch therefrom. As the clamping bar is moved inwardly the studs engage the clamping bar first. Further tightening of the tightening member causes the clamping bar to fulcrum about the studs and increase the clamping pressure on the sheet. Similarly, all tightening members are turned counter-clockwise to cause the release of the sheet from the clamping bar. If it is desired to use the metal sheet as one electrode for a given operation, electrical connection to the sheet is provided via the clamping means to assure uniform current distribution to the sheet. The clamp, when in position on the frame, engages the widened upper portion of grooves 20 and 22 on sheet support members 16 and 20 and assures that the sheet is uniformly spaced from the electrode(s) on the inside frame walls.

In the preferred method of operation, as shown in FIG. 1, the aluminum sheet 49 is positioned between the electrodes 28 and 30. This is accomplished by sliding the sheet 49 down the side support grooves 20 and 22 in sheet support members 16 and 18, respectively. The sheet is lowered through grooves 20 and 22 until the bottom portion thereof is received in the receiving groove 13 in the bottom member 12. With the sheet 49 held firmly in the grooves and centered between the electrodes 28 and 30, the top margin of the sheet 49 is then clamped, as described above, by clamping means 48. The ends of the downwardly projecting stem portion 50 of sheet clamping means 48 are seated in the somewhat wider groove tops located on the upper surface of support members 16 and 18, respectively. To accomplish the electrolysis of the metal sheet, the entire frame 10 is then transferred to a large tank holding electrolyte and submerged at least to a level covering the electrodes 28 and 30 and the sheet 49.

Then electrical connections to the electrodes 28 and 30 and to the aluminum sheet 49 through clamping means 48 are completed by connecting these elements preferably to an AC power source. An electrical connection to the clamping means is shown as means 54.

Any conventional pump means (not shown) may be connected to tubular member 44 so that electrolyte is pumped into entrance chamber 36 which then travels through the open channels of support member 18. The pumped electrolyte thus passes into the metal sheet holding central portion of the device wherein it circulates between the electrodes 28 and 30 and about the sheet 49 on both side surfaces thereof. The electrolyte finally exits the frame through the open channels 24 and 26 in support member 16 and returns to the large vessel. The vessel may contain a suitable exit port.

The pumping of electrolyte through the frame as described provides several advantages. In certain types of electrolytic etching processes a gas in particular, hydrogen gas, is given off. The pumping of the electrolye through the chambers as described, flushes this hydrogen away from any place it may be gathering on the sheet where it could interfere with the continued etching process.

The circulation of the electrolyte between the electrodes and the sheet tends to keep the temperature constant as new electrolyte constantly replaces old removing any heat buildup that might otherwise occur. With the electrodes fixed at a selected distance of, for example, 1 centimeter from each side of sheet 80, the electrolyte temperature remaining constant and hydrogen buildup being prevented, a very uniform etching process can be achieved and repeated numerous times.

What is claimed:

1. An apparatus for uniformly electrolyzing a metal sheet comprising:

(a) a generally rectagular, non-electrically conductive frame defined by planar walls, which is capable of supporting a metal sheet within said walls and which is adapted for immersion in a tank capable of containing an electrolytic solution therein;

(b) at least one electrode mounted on each of two opposite inside walls of said frame, such that said electrodes are spaced at a distance from, and in planes paralled to the metal sheet;

(c) electrically conductive clamping means capable of rigidly holding at least one of the peripheral edges of the metal sheet and engaging with said frame such that at least one of the sides of the metal sheet is uniformly spaced at a pre-selected distance from said electrodes.

(d) means for circulating electrolyte uniformly about the surface of said metal sheet and;

(e) means for applying an electrical current between said electrode or electrodes and said metal sheet.

2. The apparatus of claim 1 wherein said means for circulating electrolyte comprises a pump.

3. An apparatus for uniformly electrolyzing a metal sheet comprising:

(a) a generally rectangular, non-electrically conductive frame defined by planar walls, which is capable of supporting a metal sheet within said walls and which is adapted for immersion in a tank capable of containing an electrolytic solution therein; said metal sheet supported in said frame by means of at least one slot in said frame, which slot is adapted for receiving said sheet therein;

(b) at least one electrode mounted on at least one wall inside said frame, such that said electrode is spaced at a distance from, and in a plane parallel to the metal sheet;

(c) electrically conductive clamping means capable of rigidly holding at least one of the peripheral edges of the metal sheet and engaging with said frame such that at least one of the sides of the metal sheet is uniformly spaced at a pre-selected distance from said electrode;

(d) means for circulating electrolyte uniformly about the surface of said metal sheet and;

(e) means for applying an electrical current between said electrode or electrode or electrodes and/or said metal sheet.

4. An apparatus for uniformly electrolyzing a metal sheet comprising:

(a) a generally rectangular, non-electrically conductive frame defined by planar walls, which is capable of supporting a metal sheet within said walls and which is disposed in a vessel capable of containing an electrolytic solution therein; said frame including arms at each of the ends thereof capable of supporting said frame upon a peripheral lip of said vessel;

(b) at least one electrode mounted on at least one wall inside said frame, such that said electride is spaced at a distance from, and in a plane parallel to the metal sheet;

(c) electrically conductive clamping means capable of rigidly holding at least one of the peripheral edges of the metal sheet and engaging with said frame such that at least one of the sides of the metal sheet is uniformly spaced at a pre-selected distance from said electrode;

(d) means for circulating electrolyte uniformly about the surface of said metal sheet and;

(e) means for applying an electrical current between said electrode or electrodes and/or said metal sheet.

5. An apparatus for uniformly electrolyzing a metal sheet comprising:

(a) a generally rectangular, non-electrically conductive frame defined by planar walls, which is capable of supporting a metal sheet within said walls and which is adapted for immersion in a tank capable of containing an electrolytic solution therein;

(b) at least one electrode mounted on at least one wall inside said frame, such that said electrode is spaced at a distance from, and in a plane parallel to the metal sheet;

(c) electrically conductive clamping means capable of rigidly holding at least one of the peripheral edges of the metal sheet and engaging with said frame such that at least one of the sides of the metal sheet is uniformly spaced at a pre-selected distance from said electrode;

(d) means for circulating electrolyte uniformly about the surface of said metal sheet, said means comprising (i) a pair of chambers formed in said frame at each of two opposite ends of said frame, each chamber including entrance and exit openings through which electrolyte circulates; and (ii) means for causing electrolyte to circulate through said chambers; and;

(e) means for applying an electrical current between said electrode or electrodes and/or said metal sheet.

* * * * *